United States Patent [19]

Mitchell

[11] 4,063,909

[45] Dec. 20, 1977

[54] ABRASIVE COMPACT BRAZED TO A BACKING

[76] Inventor: Robert Dennis Mitchell, 5, Trefnant Road, Evans Park, Johannesburg, South Africa

[21] Appl. No.: 611,811

[22] Filed: Sept. 9, 1975

[30] Foreign Application Priority Data

| | | |
|---|---|---|
| Sept. 18, 1974 | South Africa | 74/5930 |
| June 17, 1975 | South Africa | 75/3863 |

[51] Int. Cl.[2] ..... B24D 3/06

[52] U.S. Cl. ..... 51/309 R; 51/295

[58] Field of Search ..... 51/293, 295, 307, 309

[56] References Cited

U.S. PATENT DOCUMENTS

| | | | |
|---|---|---|---|
| 2,216,728 | 10/1940 | Benner et al. | 51/298 |
| 3,233,988 | 2/1966 | Wentorf et al. | 51/309 |
| 3,306,720 | 2/1967 | Darrow | 51/309 |
| 3,743,489 | 7/1973 | Wentorf et al. | 51/309 |
| 3,745,623 | 7/1973 | Rocco | 51/309 |
| 3,779,726 | 12/1973 | Fisk et al. | 51/295 |
| 3,841,852 | 10/1974 | Wilder et al. | 51/295 |
| 3,852,078 | 12/1974 | Wakatsuki et al. | 51/309 |
| 3,868,234 | 2/1975 | Fontanella | 51/309 |
| 3,871,840 | 3/1975 | Wilder et al. | 51/309 |
| 3,879,901 | 4/1975 | Caveney | 51/309 |
| 3,936,577 | 2/1976 | Christini et al. | 51/309 |

*Primary Examiner*—Donald J. Arnold
*Attorney, Agent, or Firm*—Young & Thompson

[57] ABSTRACT

An abrasive compact comprising diamond or cubic boron nitride abrasive particles or a mixture thereof, present in an amount of at least 50 volume percent, bonded into a hard conglomerate, preferably by means of a bonding matrix, and having a metal layer bonded to at least one surface thereof, is characterized by the metal being a high temperature braze metal capable of wetting the abrasive compact, preferably titanium or a titanium alloy, and the compact being substantially free of deteriorated abrasive particles.

14 Claims, 3 Drawing Figures

ABRASIVE COMPACT BRAZED TO A BACKING

This invention relates to abrasive bodies and in particular to abrasive compacts.

Abrasive compacts are known in the art and consist of a mass of abrasive particles, particularly diamond or cubic boron nitride particles, bonded into a hard conglomerate preferably by means of a suitable bonding matrix, usually a metal. The abrasive particle content of compacts is at least 50 volume percent and generally at least 70 volume percent. Suitable bonding matrices are, for example, cobalt, iron, nickel platinum, titanium, chromium, tantalum and alloys containing one or more of these metals.

When the abrasive particles of the compact are diamond or cubic boron nitride, the compact is made under conditions of temperature and pressure at which the particle is crystallographically stable. Such conditions are well known in the art. It is preferred that the matrix when provided, is capable of dissolving the abrasive particle at least to a limited extent. With such matrices a certain amount of intergrowth between the particles occurs during compact manufacture.

Abrasive compacts are bonded to a suitable support which may be metal or cemented tungsten carbide and then used for cutting, grinding and like abrading operations. Bonding of the abrasive compact to a support may be achieved by means of a low temperature braze. Such brazing is, however, not very efficient. Another proposal has been to use a titanium hydride/solder method but the conditions of this method inevitably leads to deterioration of the abrasive particle of the compact.

As an alternative to brazing, it has been proposed to produce an in situ bond between a diamond or cubic boron nitride compact and a cemented tungsten carbide backing during compact manufacture by infiltration of the bonding metal from the tungsten carbide backing into the diamond or cubic boron nitride layer, as in U.S. Pat. Nos. 3,743,489 and 3,745,623.

According to this invention an abrasive compact comrising diamond or cubic boron nitride abrasive particles or a mixture thereof, present in an amount of at least 50 volume percent, bonded into a hard conglomerate, and having a metal layer bonded to at least one surface thereof, is characterised in that the metal is a high temperature braze metal capable of wetting the abrasive compact and the compact is substantially free of deteriorated abrasive particle.

BRIEF DESCRIPTION OF DRAWINGS

The abrasive compact may readily be bonded to a support by bonding the layer of high temperature braze to the support by means of a suitable low temperature braze such as bronze. The result is a very effective bond between compact and support and one having a greater strength than that obtainable by use of a low temperature braze alone. Compacts may have a variety of shapes and the layer of high temperature braze will be bonded to the surface of the compact which is to be bonded to the support. Compacts are frequently in the form of a segment of a circle and in this case it is usual to bond the layer of high temperature braze to one of the major flat surfaces thereof. By way of example, FIG. 1 of the attached drawing illustrates such as segment. In FIG. 1, the compact is shown at 10 and the layer of high temperature braze metal at 12.

The high temperature braze metal will include both pure metals and alloys. In order to achieve effective bonding between the layer and the compact the metal is so chosen that it is capable of wetting the abrasive compacts, i.e. capable of wetting the abrasive particle of the compact or of wetting or alloying with the bonding matrix of the compact, when such is provided.

Suitable high temperature braze metals include a transition metal such as titanium, nickel, cobalt, iron, chromium, manganese, vanadium, molybdenum, tantalum or platinum or an alloy containing one or more of these transition metals. Particularly preferred metals are titanium and titanium alloys such as copper/titanium and copper/tin/titanium alloys.

The thickness of the layer will vary according to the method by which the layer is applied to the compact. However, the layer will generally be less than 0.5 mm in thickness.

As mentioned above, the compact of the invention is also characterised by the fact that it is substantially free of deteriorated abrasive particle. This means that the compact is substantially free of graphite, which results from the deterioration of diamond, and hexagonal boron nitride, which results from the deterioration of cubic boron nitride. In bonding the high temperature braze to the compact it is important to ensure that deterioration of the compact in this manner is inhibited.

The abrasive particle content of the compact is diamond, cubic boron nitride or a mixture thereof. It is preferable that the bonding matrix, when provided, is one which will act as a solvent for the abrasive particle. With such a bonding matrix, intergrowth between the particles can occur if conditions of temperature and pressure at which the particle is crystallographically stable are employed during compact manufacture. Solvents for diamond are well known in the art include cobalt, nickel and iron and alloys containing one or more of these metals. Solvents for cubic boron nitride are also well known in the art and include aluminium, lead, tin, magnesium and lithium and alloys containing one or more of these metals.

Figure 3:
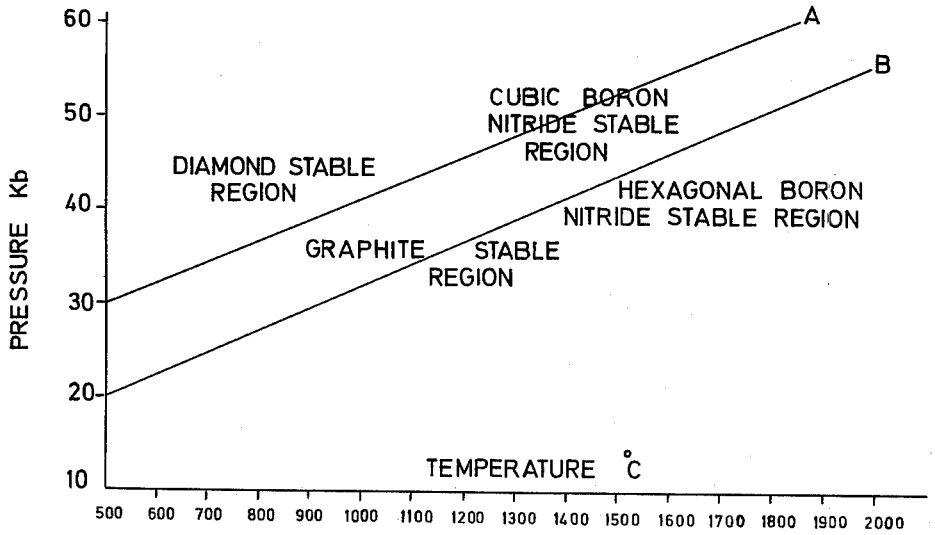
FIG. 3 illustrates the crystallographically stable conditions of temperature and pressure for diamond and cubic boron nitride.

The abrasive compact of the invention may be made by forming a mixture of the abrasive particles and powdered bonding matrix, placing the mixture in contact with a layer of high temperature braze metal and subjecting the mixture and layer to conditions of elevated temperature and pressure in the crystallographically stable range of the abrasive particle suitable for forming a compact of the mixture. This method forms another aspect of the invention. As mentioned above, the crystallographically stable conditions of diamond and cubic boron nitride are well known in the art and FIG. 3 of the attached drawings illustrates these conditions. The diamond stable region is above line A and the cubic boron nitride stable region is above line B. The high temperature braze metal may be powdered or in the form of a thin foil. The thickness of the powdered layer or foil will generally be less than 0.5 mm. This method achieves the simultaneous formation of the compact and bonding of the braze metal layer to a surface thereof.

Very effective bonding between the braze metal and the compact is produced.

Another method of forming the compact of the invention, which method forms another aspect of the invention, comprises depositing a layer of high temperature braze metal on a surface of an abrasive compact which comprises diamond or cubic boron nitride abrasive particles or a mixture thereof, present in an amount of at least 50 volume percent, bonded into a hard conglomerate, and subjecting the whole to heat treatment under conditions at which deterioration of the abrasive particle is inhibited to cause the layer to bond to the compact. Deterioration of the abrasive particle may be inhibited by heat treating at a temperature not exceeding 800° C in an inert atmosphere. The inert atmosphere may be an inert gas such as argon or neon or a vacuum of, for example $10^{-4}$ Torr or better. Alternatively, the heat treatment may be carried out at an applied pressure suitable to place the conditions in the crystallographically stable region of the abrasive particle.

The deposition of the braze metal layer on the surface of the abrasive compact may be carried out using known techniques, preferably vacuum deposition. In the case of vacuum deposition the thickness of the layer will generally be in the range 0.1 to 0.5 micron.

The abrasive compact of the invention may be bonded to a support such as a shank to form a tool or may be bonded to a suitable support backing such as a cemented tungsten carbide backing. Bonding may be achieved by bonding the high temperature braze metal layer to the support using a low temperature braze metal.

Figure 2:
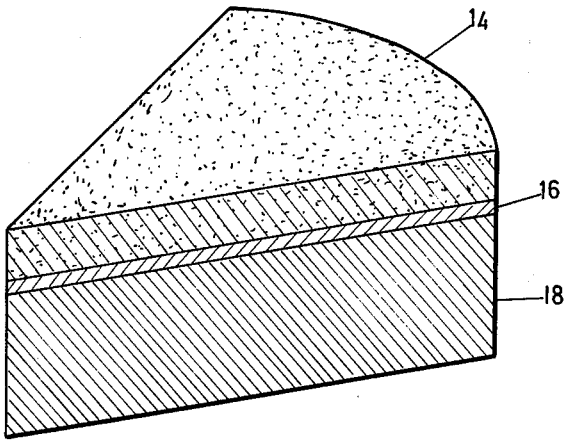
FIG. 2 illustrates a compact of the present invention bonded to a backing member.

In the case of support backings such as cemented tungsten carbide support backings these may be bonded in situ to the abrasive compacts by the first method described above by placing the formed backing or a powder mixture capable of producing the backing in contact with the braze metal and then subjecting the whole to the above described temperature and pressure conditions. FIG. 2 of the attached drawings illustrates a compact of the invention bonded to a tungsten carbide backing. In this Figure, the compact is shown at 14, the layer of high temperature braze metal at 16 and the tungsten carbide backing at 18. In general, the tungsten carbide backing will be considerably larger in volume than the compact.

The following examples illustrate the invention.

EXAMPLE 1

Figure 1:
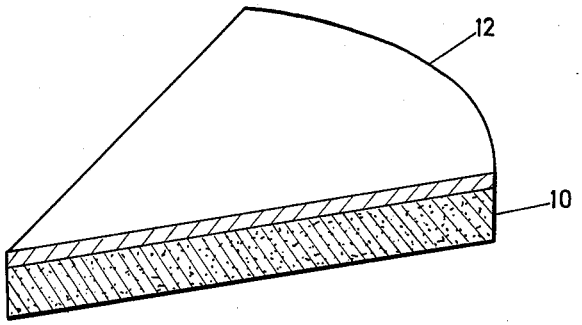
FIG. 1 illustrates a segment of a circle of the abrasive compact of the present invention.

A diamond compact consisting of 80 volume percent diamond particles and 20 volume percent cobalt binder was made using conventional techniques. The compact was in the form of a segment of a circle as illustrated in FIG. 1. A thin layer (thickness about 0.5 microns) of titanium was deposited on one of the major flat surfaces of the compact by standard vacuum deposition techniques. The compact, with the titanium layer, was then heat treated at a temperature of about 500° C for 15 minutes in a vacuum of $10^{31\ 4}$ Torr. The compact was then bonded to a tungsten carbide backing by bonding the titanium layer to the backing using a commercially available low temperature braze. A very good bond between the backing and the compact was achieved.

EXAMPLE 2

The following were placed in the reaction capsule of a conventional high temperature/pressure apparatus: a tungsten carbide backing in contact with a thin layer (thickness 100 micron) of titanium metal and mixture of powdered cobalt and diamond particles on the titanium layer. The powdered cobalt constituted 20 volume percent of the mixture and the diamond 80 volume percent. The capsule was placed in the reaction zone of a conventional high temperature/pressure apparatus and the pressure raised to about 55 kilobars and the temperature raised to about 1600° C. The temperature and pressure conditions were maintained for a time sufficient to allow a compact to form from the diamond/cobalt mixture. The temperature and pressure conditions were then released. Recovered from the reaction capsule was an abrasive body consisting of a diamond compact bonded to a tungsten carbide backing by means of a thin titanium layer. The compact was firmly bonded to the backing. The body was a circular disc which was cut into segments of the type shown in FIG. 2 using standard cutting techniques.

EXAMPLE 3

A cobalt/diamond compact was made in the conventional manner. The diamond content of the compact was 80 volume percent and the cobalt content 20 volume percent. The compact was in the form of a segment of a circle as illustrated by FIG. 1. A nickel layer of thickness 0.5 microns was deposited on a major flat surface of the compact using conventional vacuum deposition techniques. The compact, with the nickel layer, was then heat treated for a period of two hours at 800° C in a vacuum of $10^{31\ 4}$ Torr. This treatment resulted in the nickel being strongly bonded to the compact.

The nickel layer was then bonded to a steel shank using a commercially available braze having a melting point of 620° C. This resulted in the compact being firmly bonded to the shank.

I claim:

1. In an abrasive body comprised by a backing of cemented tungsten carbide or steel, and an abrasive compact secured by a surface of said compact to a surface of said backing, said abrasive compact comprising abrasive particles selected from diamond, cubic boron nitride, and mixtures thereof, said abrasive particles being bonded into a hard conglomerate by a matrix metal that is capable of dissolving the abrasive particles at least to a limited extent, there being intergrowth between said abrasive particles, and said abrasive particles being present in an amount of at least 70 volume percent of said compact; the improvement comprising, disposed between said surface of said compact and said surface of said backing, a continuous layer of high temperature braze metal selected from titanium, chromium, manganese, vanadium, molybdenum, platinum, iron, cobalt and nickel and alloys containing one or more of these metals, said layer having a thickness less than 0.5 mm, said compact being secured to said backing through said continuous layer.

2. An abrasive body according to claim 1 wherein the metal lager is titanium.

3. An abrasive body according to claim 1 wherein the metal layer is selected from a copper/titanium and copper/tin/titanium alloy.

4. An abrasive body according to claim 1 in the form of a segment of a circle, the metal layer being bonded to one of the major flat faces thereof.

5. In a method of making an abrasive body comprised by a backing of cemented tungsten carbide or steel, and an abrasive compact secured by a surface of said compact to a surface of said backing, said abrasive compact comprising abrasive particles selected from diamond, cubic boron nitride, and mixtures thereof, said abrasive particles being bonded into a hard conglomerate by a matrix metal that is capable of dissolving the abrasive particles at least to a limited extent, there being intergrowth between said abrasive particles, and said abrasive particles being present in an amount of at least 70 volume percent of said compact; the improvement comprising disposing between said surface of said compact and said surface of said backing a continuous layer of high temperature braze metal selected from titanium, chromium, manganese, vanadium, molybdenum, platinum, iron, cobalt and nickel and alloys containing one or more of these metals, said layer having a thickness less than 0.5 mm, and securing said compact to said backing through said continuous layer.

6. A method according to claim 5 in which said compact is produced by forming a mixture of said abrasive particles and a powder of said matrix, the mixture is placed in contact with said continuous layer, and the mixture and layer are subjected to conditions of elevated temperature and pressure in the crystallographically stable range of the abrasive particles suitable for forming a compact of the mixture.

7. A method according to claim 5 wherein said continuous layer is deposited on a surface of said compact and the whole is subjected to heat treatment under conditions at which deterioration of the abrasive particle is inhibited to cause the layer to bond to the compact.

8. A method according to claim 7 wherein the heat treatment is at a temperature not exceeding 800° C and is carried out in an inert atmosphere.

9. A method according to claim 8 wherein the inert atmosphere is a vacuum.

10. A method according to claim 7 wherein the heat treatment is carried out at an applied pressure suitable to place the conditions in the crystallographically stable region of the abrasive particle.

11. An abrasive body according to claim 1 wherein the matrix metal is cobalt.

12. An abrasive body according to claim 1 wherein the thickness of said layer is 0.1 to 0.5 micron.

13. A method according to claim 5 wherein the matrix metal is cobalt.

14. A method according to claim 5 wherein the thickness of said layer is 0.1 to 0.5 micron.

* * * * *